United States Patent [19]

Vostermans et al.

[11] Patent Number: 4,600,362

[45] Date of Patent: Jul. 15, 1986

[54] IMPELLER FOR AXIAL FAN WITH BLADE LOCKING MEANS

[75] Inventors: A. G. Vostermans; H. L. Vostermans, both of Venlo, Netherlands

[73] Assignee: A.G. Vostermans B.V., Netherlands

[21] Appl. No.: 673,923

[22] Filed: Nov. 21, 1984

[30] Foreign Application Priority Data

Dec. 21, 1983 [NL] Netherlands ..... 8304378

[51] Int. Cl.[4] ..... F01D 5/32

[52] U.S. Cl. ..... 416/208; 416/220 R

[58] Field of Search ..... 416/208, 207, 205, 210 A, 416/210 R, 214 A, 214 R, 221, 222, 220 R, 220 A, 219 R, 219 A, 244 A, 248, 500, 61, 206, DIG. 3; 415/148; 403/4, 336, 355, 380

[56] References Cited

U.S. PATENT DOCUMENTS

| | | | |
|---|---|---|---|
| 939,829 | 11/1909 | Grundy | 403/336 |
| 2,751,189 | 6/1956 | Ledwith | 416/221 |
| 3,161,239 | 12/1964 | Andersen | 416/208 |
| 3,219,314 | 11/1965 | Petrie | 416/220 R |
| 3,409,489 | 11/1968 | Renton | 416/214 R |
| 3,514,136 | 5/1970 | Kennicott | 403/380 |

FOREIGN PATENT DOCUMENTS

| | | | |
|---|---|---|---|
| 2344710 | 11/1977 | France | 416/220 R |
| 713855 | 8/1954 | United Kingdom | 416/61 |
| 1085344 | 11/1967 | United Kingdom . | |

*Primary Examiner*—Robert E. Garrett
*Assistant Examiner*—H. Edward Li
*Attorney, Agent, or Firm*—Steele, Gould & Fried

[57] ABSTRACT

An impeller for an axial fan, this impeller comprising a hub transversally split into two parts each defining recesses into root portions of a plurality of impeller blades are inserted and locked by means of key-pieces when the two parts are joined together. Each key-piece has two spaced projections on one side for engaging two corresponding recesses diametrically located in the end surface of the root of each impeller blade close to the periphery of this end surface, and two equally spaced projections on its other side for engaging two corresponding recesses provided in the bottom surface of the recess in the hub. These pairs of projections on both sides of the key-piece which is preferably ring-shaped, are advantageously shifted from a certain angle along the circumference of the ring. The amount of angular displacement of the projections can be determined by mere adjustment of the mold in which the key-pieces are produced.

2 Claims, 1 Drawing Figure

IMPELLER FOR AXIAL FAN WITH BLADE LOCKING MEANS

Figure 1:
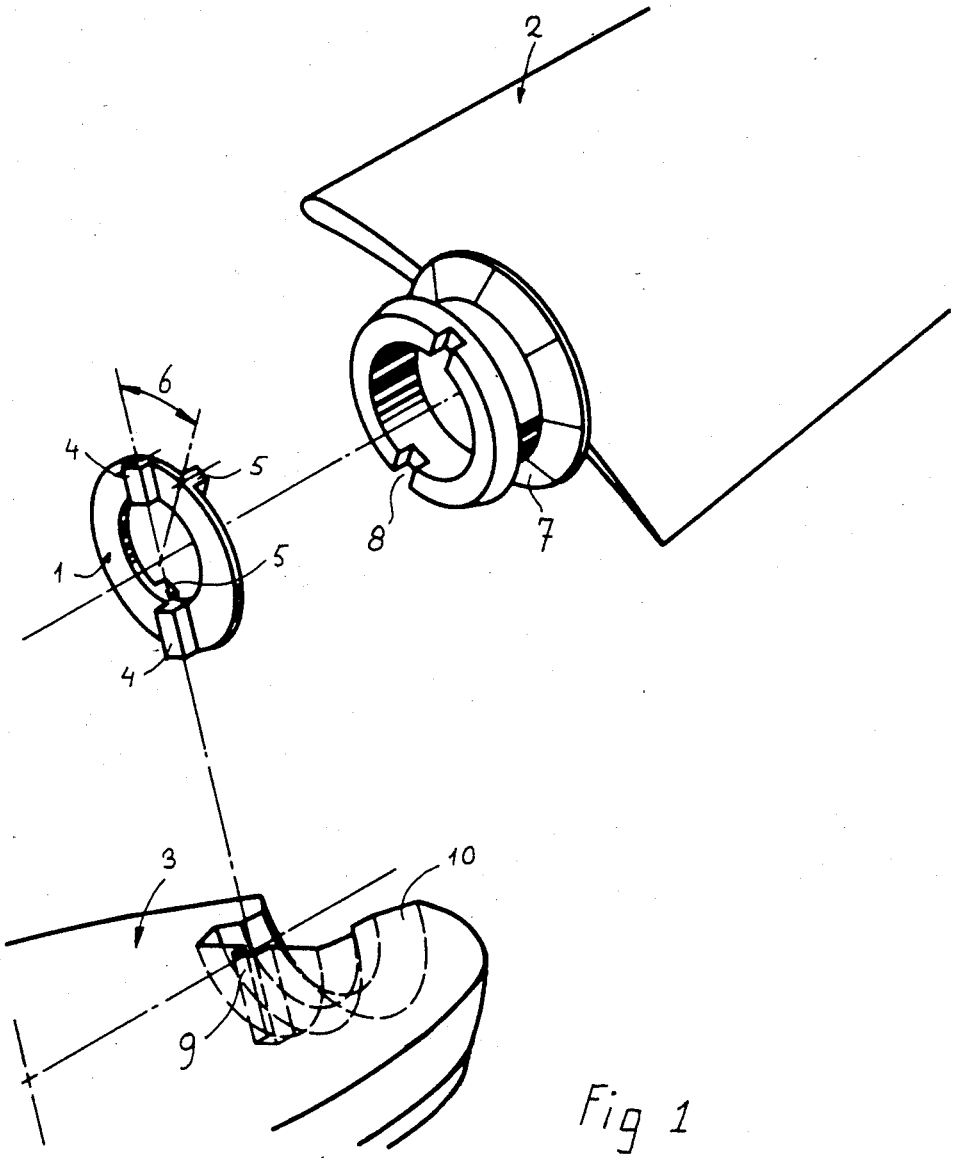

The present invention relates to an impeller for an axial fan, of the type comprising a hub transversally split into two parts each defining recesses in which root portions of a plurality of impeller blades are inserted and locked when the two parts are joined together.

This particular type of impeller construction which is already known as such, has the advantages of being simple to assemble with a limited number of parts.

With regard rational mass-production, it is however important to construct impellers capable of having different characteristic with only one single type of impeller blade.

An impeller having such a construction advantage is disclosed in British Pat. No. 1,085,344 issued on Sept. 37, 1967. In this British patent, a key-piece is disclosed, which is intended to be located between the end of the root of each impeller blade and the bottom of the corresponding recess in the hub to prevent the impeller blade from rotating in its recess. This particular arrangement of course determines the pitch angle of the assembled impeller.

A disadvantage of this known construction is the fact that the side of the key-piece which is in contact with the hub to lock the same, has a shape different from the one of the other side of the key-piece which is in contact with the impeller root, such a difference preventing the use of fast production processes. Furthermore, the projections provided on each key-piece to prevent rotation of the root of the impeller blade in it recess in the hub are located close to the center of this recess. As a result, tolerances in the dimensions of the hub, root of the blade and key-piece influence to a large extent the accuracy with which a desired pitch angle can be obtained with a mass production process.

The object of the present invention is to provide an impeller assembly which does not have the above mentioned disadvantages.

In accordance with the invention, this object is achieved by using key-pieces having two spaced projections on one side for engaging two corresponding recesses diametrically located in the end surface of the root of each impeller blade close to the periphery of this end surface, and two equally spaced projections on its other side for engaging two corresponding recesses provided in the bottom surface of the recess in the hub. These pairs of projections on both sides of the key-piece which is preferably ring-shaped, are advantageously shifted from a certain angle along the circumference of the ring. The amount of angular displacement of the projections can be determined by mere adjustment of the mold in which the key-pieces are produced. In this way, a hub and impeller blade assembly is obtained in which rotation of the root in each recess is prevented by the above mentioned key-pieces each provided with four projections.

By using a special tapered form of root and recess in the hub, radial movement of the blade can also be prevented.

The impeller assembly according to the invention is particularly interesting in that the symmetrical shape of its key-pieces make it possible to use this key-pieces in any of four possible orientations, thereby substantially reducing the risk of making mistakes during the assembly. To further reduce these risks of making mistakes in the assembly, use can be made of colour codes to identify the key-pieces to be used for different pitch angles.

The invention and its advantages will be better understood upon reading of the following non restrictive description given with reference to the accompanying drawings, wherein the single FIGURE is an exploded, perspective view showing one part of a hub, a ring shaped key-piece and the root of an impeller blade according to the invention.

The key-piece 1 used in the impeller assembly according to the invention is ring shaped and has on both sides two equally shaped projections 4 and 5 that are diammetrically opposite and shifted at a certain angle 6 with respect to each other. These key-pieces can advantageously be made of plastic material.

The angle 6 is chosen at the production of the key-piece, by using an adjustable mold. The key-pieces are advantageously produced in different colour, each colour corresponding to the most often needed angles to reduce as much as possible the risks of making mistakes in the production process.

The extensions 4 and 5 lock into corresponding recesses 8 provided in the end surface of the root 7 of each impeller blade 2. The root of the impeller blade with the key-piece 1 fitted to its end, may be locked into a recess 10 provided in the part 3 of the hub. The projections 4 and 5 on the other side of the key-pieces actually lock into keyways 9 provided in the bottom surface of the recess 10, which bottom surface is opposite to the end surface of the root 7.

What is claimed is:

1. An impeller for an axial fan, said impeller comprising a hub transversally split into two parts each defining recesses into which root portions of a pluraity of impeller blades are inserted and locked when the two parts are joined together, said impeller further comprising a ring shaped key-piece of substantially the same exteral diameter as the end surface of the root portion of each blade in each of said recesses to prevent rotation of the root portion of each blade in its corresponding recess, the end surface of the root portion of each blade having two diametrically opposite recesses of the same size, said recesses being located adjacent to the periphery of said end surface;

the surface of each recess defined in the hub, which surface is opposite to the end surface of the root portion of the corresponding blade, having two diametrically opposite recesses of the same size as the recesses in the end surface of said root portion; and each of the key-pieces having two sides each provided with two equally shaped projections respectively located and positioned to engage the recesses provided in the end surface of the root portion of each blade and in the opposite surface of each recess defined in the hub to positively lock the blade with respect to the hub, the projections on one side of each key-piece being circumferentially located at an angle wih respect to the projections on the other side of said key-piece.

2. The impeller of claim 1, wherein the root portions of the blades and the corresponding recesses in the hub are similarly tapered to prevent any radial movement of the blades with respect to the hub.

* * * * *